US009916948B2

(12) United States Patent
Brudzynsky et al.

(10) Patent No.: US 9,916,948 B2
(45) Date of Patent: Mar. 13, 2018

(54) BUTTON WITH FLEXIBLE LIGHT CONDUCTOR

(71) Applicant: Continental Automotive Systems, Inc., Auburn Hills, MI (US)

(72) Inventors: Daniel Arthur Brudzynsky, Waterford, MI (US); Orthell LaVount Adams, Ypsilanti, MI (US); Christian Tanguy, Rochester, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 15/002,653

(22) Filed: Jan. 21, 2016

(65) Prior Publication Data

US 2017/0194118 A1 Jul. 6, 2017

Related U.S. Application Data

(60) Provisional application No. 62/273,546, filed on Dec. 31, 2015.

(51) Int. Cl.

| | |
|---|---|
| ***H01H 9/00*** | (2006.01) |
| ***H01H 23/02*** | (2006.01) |
| *H01H 23/08* | (2006.01) |
| *H01H 23/00* | (2006.01) |

(52) U.S. Cl.

CPC ..... *H01H 23/025* (2013.01); *H01H 23/006* (2013.01); *H01H 23/08* (2013.01); *H01H 2215/00* (2013.01); *H01H 2219/048* (2013.01); *H01H 2219/062* (2013.01)

(58) Field of Classification Search

CPC .. H01H 23/006; H01H 23/08; H01H 2215/00; H01H 21/00; H01H 21/02; H01H 21/04; H01H 23/00; H01H 23/02; H01H 23/025; H01H 23/04; H01H 23/14; H01H 23/23; H01H 2219/048; H01H 2219/062; H01H 2003/00; H01H 2003/02; H01H 2003/12; H01H 2009/02; H01H 2221/00; H01H 2221/016; H01H 3/00; H01H 3/12; H01H 3/04; H01H 3/02; H01H 3/06; H01H 9/16; H01H 9/161; H01H 9/18; H01H 13/00; H01H 13/02; H01H 13/023; H01H 13/14; H01H 13/20; H01H 13/50

USPC ..... 200/315

See application file for complete search history.

(56) References Cited

U.S. PATENT DOCUMENTS 4,024,368 A * 5/1977 Shattuck ..... H01H 13/84 200/314
4,710,602 A * 12/1987 Baity ..... H01H 13/705 200/315
6,664,489 B2 * 12/2003 Kleinhans ..... H03K 17/962 200/313

(Continued)

*Primary Examiner* — Anthony R. Jimenez

(57) ABSTRACT

A button assembly configured to be illuminated is provided. The button assembly includes a movable button having a viewing surface and a back side. The button has portions defining a window in the viewing surface. A flexible light conductor is disposed on the back side of the button. The flexible light conductor has an inlet end configured to receive light, and the flexible light conductor has a light-emitting portion disposed adjacent to the window. The flexible light conductor is configured to conduct light from the inlet end to the light-emitting portion. The light-emitting portion is configured to emit light so that the light is visible through the window.

2 Claims, 5 Drawing Sheets

(56) References Cited

U.S. PATENT DOCUMENTS

| | | | | |
|---|---|---|---|---|
| 6,670,567 | B1 * | 12/2003 | Koseki | H01H 19/005 200/17 R |
| 2009/0067151 | A1 * | 3/2009 | Sahlin | G02B 6/0035 362/23.03 |
| 2010/0128427 | A1 * | 5/2010 | Iso | G06F 1/1616 361/679.09 |
| 2011/0272262 | A1 * | 11/2011 | Chen | H01H 13/83 200/5 A |

* cited by examiner

BUTTON WITH FLEXIBLE LIGHT CONDUCTOR

FIELD

The present invention relates to a button assembly for actuating a switch to provide a command, and more particularly, a button assembly that has components to provide light to the button.

BACKGROUND

In the field of instrumentation design, with particular reference to vehicle interiors, there are often a number of different mechanical buttons or capacitive nodes in the interior of the vehicle that function to operate switches or control other vehicle functions.

Some buttons including lighting, so that a telltale, graphic, words, or numbers on the button can be illuminated. Typically, when the button is pressed, the luminance or brightness of the telltale or graphic changes, because the light pick-up feature on the button moves with respect to the light source, which is typically fixed on a printed circuit board (PCB). As the distance changes between the light pick-up feature and the light source, the light intensity is decreased or increased as the button moves. Thus, a phenomenon known as "blink" occurs, because the button lighting appears to "blink" or become more or less illuminated when the button is depressed.

Accordingly, there is a need for more uniform light distribution in a moving button.

SUMMARY

Disclosed is a button assembly having a rotatable or pivotable button that is illuminated with a flexible light conductor. An inlet end of the light conductor can remain fixed with respect to a light source, while a light-emitting end or ends, or light-emitting portions, can move with the button.

In one example, which may be combined with or separate from other examples disclosed herein, there is contemplated a button assembly configured to be illuminated. The button assembly includes a movable button having a viewing surface and a back side. The button has portions defining at least one window in the viewing surface. A flexible light conductor is disposed on the back side of the button. The flexible light conductor has an inlet end configured to receive light. The flexible light conductor has a light-emitting portion disposed adjacent to the window, and the flexible light conductor is configured to conduct light from the inlet end to the light-emitting portion. The light-emitting portion is configured to emit light so that the light is visible through the window.

In another example, which may be combined with or separate from the other examples disclosed herein, a rocker button assembly is provided, which includes a bezel defining an opening. A rocker button is rotatably mounted to the bezel and located within the opening. The rocker button is pivotable about an axis between a neutral position, a first actuated position, and a second actuated position. The rocker button has a viewing surface and a back side. The viewing surface has portions defining at least one window. A flexible light conductor is disposed on the back side of the rocker button. The flexible light conductor has an inlet end configured to receive light, and the flexible light conductor has a light-emitting portion disposed adjacent to the window. The flexible light conductor is configured to conduct light from the inlet end to the light-emitting portion. The light-emitting portion is configured to emit light so that the light is visible through the window. A backing plate fixes the light-emitting portion to the rocker button. The light-emitting portion is movable with the rocker button. The inlet end of the flexible light conductor is fixed with respect to the bezel.

In another example, which may be combined with or separate from the other examples disclosed herein, a tilt button assembly is provided that includes a bezel defining an opening. The bezel has a first end and a second end. A tilt button is rotatably mounted to the first end of the bezel and located within the opening. The tilt button is pivotable about an axis between a neutral position and an actuated position. The tilt button has a viewing surface and a back side, and the viewing surface has portions defining a window. A flexible light conductor is disposed on the back side of the tilt button. The flexible light conductor has an inlet end configured to receive light, and the flexible light conductor has a light-emitting portion disposed adjacent to the window. The flexible light conductor is configured to conduct light from the inlet end to the light-emitting portion. The light-emitting portion is configured to emit light so that the light is visible through the window. A backing plate fixes the light-emitting portion to the tilt button, and the light-emitting portion is movable with the tilt button. The flexible light conductor extends through an opening defined by at least one of the tilt button and the backing plate. The inlet end of the flexible light conductor is fixed against movement with respect to the bezel.

Further areas of applicability will become apparent from the detailed description provided hereinafter. It should be understood that the detailed description and specific examples are intended for purposes of illustration only and are not intended to limit the scope of the invention.

BRIEF DESCRIPTION OF THE DRAWINGS

The present disclosure will become more fully understood from the detailed description and the accompanying drawings, wherein.

DETAILED DESCRIPTION

The following description is merely exemplary in nature and is in no way intended to limit the invention, its application, or uses.

Figure 1:
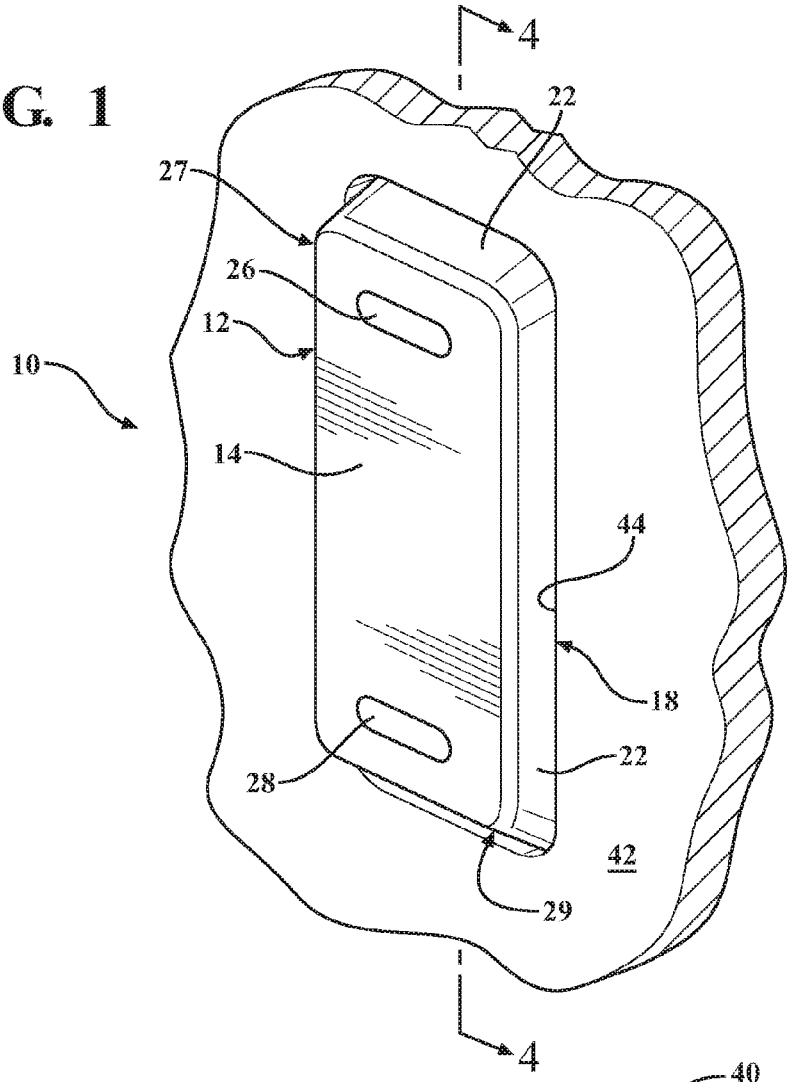
FIG. 1 is a perspective front view of a button assembly, in accordance with the principles of the present disclosure.
Figure 3:
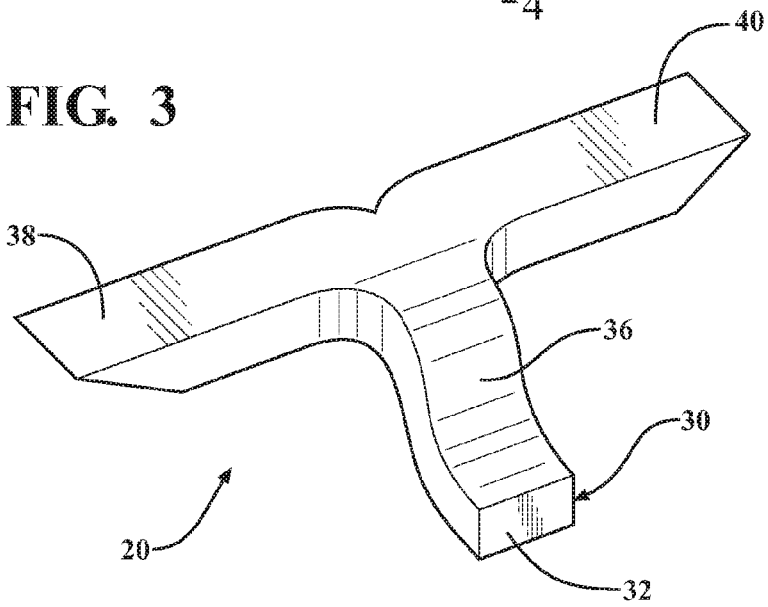
FIG. 3 is a perspective view of a flexible light conductor of the button assembly of FIGS. 1-2, in accordance with the principles of the present disclosure.
Figure 2:
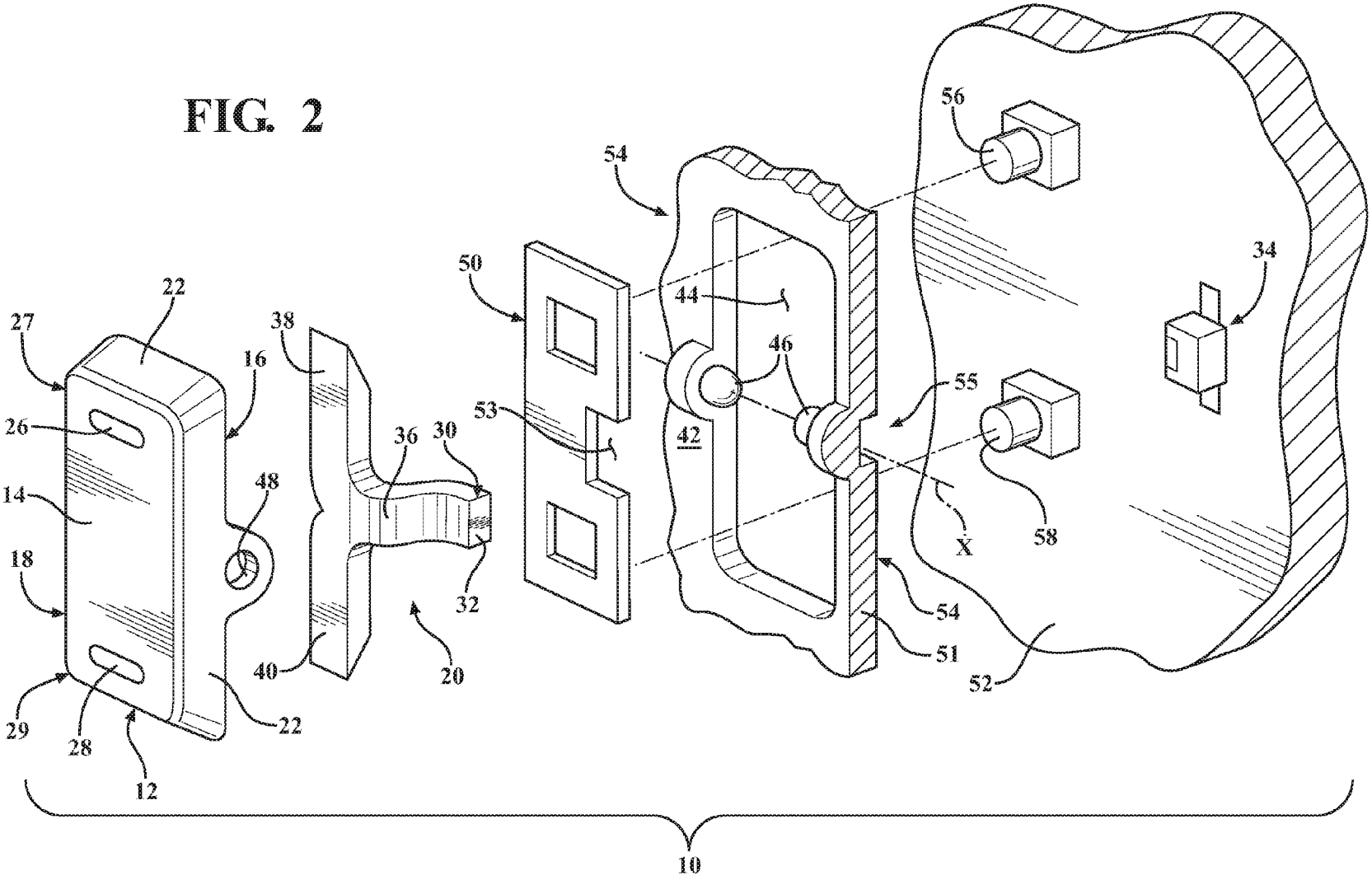
FIG. 2 is an exploded view of the button assembly of FIG. 1, according to the principles of the present disclosure.

Referring now to FIGS. 1-6, a button assembly is illustrated and generally designated at 10. The button assembly 10 includes a movable button 12, which in this example is a rocker button. The rocker button 12 has a top surface, or viewing surface 14, and a back side 16. The viewing surface 14 of the rocker button 12 may have a planar, flat shape, as shown in FIGS. 1-2, or in the alternative, the viewing surface 14 could be curved, by way of example. A main body 18 of the rocker button 12 may be formed of an opaque material, such as a plastic.

The button assembly 10 is configured to be illuminated and includes a flexible light conductor 20 disposed adjacent to the back side 16 of the button 12. For example, the button 12 may have sides 22 that defining a cavity 24 comprising the back side 16, and the flexible light conductor 20 may be partially disposed in the cavity 24. The flexible light conductor 20 may contact the back side 16 of the button 12 or simply be disposed adjacent to the back side 16.

The button 12 has portions defining one or more windows, such as a first window 26 and a second window 28 in the viewing surface 14. The first window 26 is disposed at a first end 27 of the rocker button 12, and the second window 28 is disposed at a second end 29 of the rocker button 12. The windows 26, 28 may comprise transparent or translucent material, or no material, that allows light to be visible through the windows 26, 28. As explained more below, the windows 26, 28 may form a graphical, alphabetical, or numerical shape to display pictures, words, or numbers, if desired.

The flexible light conductor 20 has an inlet end 30 having a light-receiving surface 32 configured to receive light from a light source 34. The flexible light conductor 20 is configured to receive light into the light-receiving surface 32 of the inlet end 30 and to conduct the light through the body 36 of the flexible light conductor 20 to one or more light-emitting portions or surfaces 38, 40. For example, the flexible light conductor 20 is configured to emit light through a first light-emitting surface 38 and a second light-emitting surface 40. The first and second light-emitting surfaces 38, 40 are disposed adjacent to the first and second windows 26, 28 respectively, and each light-emitting surface 38, 40 is configured to emit light so that the light is visible through the respective windows 26, 28.

The flexible light conductor 20 may be formed of silicon, by way of example. In some cases, an advanced silicon Light Guide Sheet (LGS) manufactured by Abatek can be used. The flexible light conductor 20 may be formed from a sheet that is stamped and laser etched. For example, the flexible light conductor 20 can be laser engraved with an optical pattern. In another example, the flexible light conductor 20 can be molded from optically clear silicon material.

The button assembly 10 may also include a bezel 42 defining an opening 44. The rocker button 12 may be rotatably mounted to the bezel 42, for example, by pegs 46 and sockets 48, with a portion of the button 12 being located within the opening 44. More particularly, the rocker button 12 has sockets 48, and the bezel 42 has corresponding pegs 46 extending into the opening 44 of the bezel 42. The sockets 48 of the button 12 can be snapped onto the pegs 46 of the bezel 42. It should be understood that the pegs 46 could alternatively be located on the rocker button 12 and the sockets 48 on the bezel 42.

A backing plate 50 fixes the light-emitting portions 38, 40 of the flexible light conductor 20 to the rocker button 12. For example, the backing plate 50 may be press-fit or attached in any other suitable way to the button 12. The backing plate 50 is attached over the back side 16 of the button 12, with the light-emitting portions 38, 40 of the flexible light conductor 20 being sandwiched between the backing plate 50 and the back side 16 of the button 12. Therefore, the light-emitting portions 38, 40 are movable with the rocker button 12, so that the light-emitting portions 38, 40 and the rocker button 12 are rotatable with respect to the bezel 42.

While the light-emitting portions 38, 40 of the flexible light conductor 20 are movable with respect to the bezel 42, the inlet end 30 of the flexible light conductor 20 is fixed against movement with respect to the bezel 42. The inlet end 30 may be fixed to a printed circuit board (PCB) 52, which is also fixed with respect to the bezel 42. The PCB 52 may be disposed on a rear side 54 of the bezel 42. The light source 34, which may be a light-emitting diode (LED), may be disposed on the PCB 52 adjacent to the light-receiving surface 32. The LED 34 may be a side-emitting LED 34, such that rays from the LED 34 are emitted in a direction generally parallel to the PCB 52 and generally perpendicular to the light-receiving surface 32 of the flexible light conductor 20. Thus, the light-receiving surface 32 lays generally perpendicular to the PCB 52.

The body portion 36 of the flexible light conductor 20 extends from a side 51 of the bezel 42 and from the cavity 24 of the button 12. The body portion 36 may extend through an opening 53 at least partially formed in the backing plate 50 and an opening 55 in the side 51 of the bezel 42. Thus, the light source 34 can be disposed outside of the cavity 24 but still illuminate the windows 26, 28 through the use of the flexible light guide 20.

First and second tactile switches 56, 58 may also be disposed on the PCB 52. The first end 27 of the rocker button 12 is configured to actuate the first tactile switch 56, and the second end 29 of the rocker button 12 is configured to actuate the second tactile switch 58. When the first or second end 27, 29 is pressed toward the respective tactile switch 56, 58, the respective tactile switch 56, 58 is depressed by the respective end 27, 29 of the button 12, for example, via backing plate 50.

Figure 4:
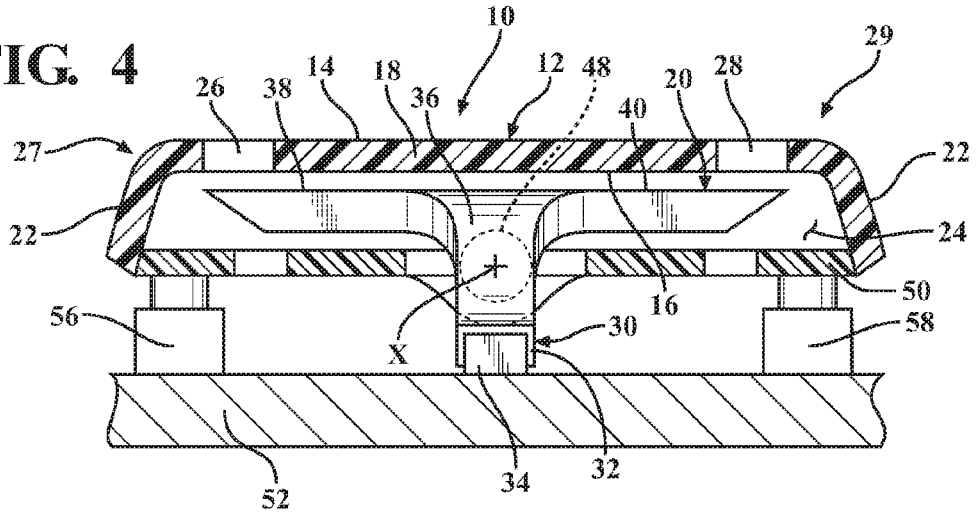
FIG. 4 is a side cross-sectional view of the button assembly of FIGS. 1-2 in a neutral position, according to the principles of the present disclosure.
Figure 5:
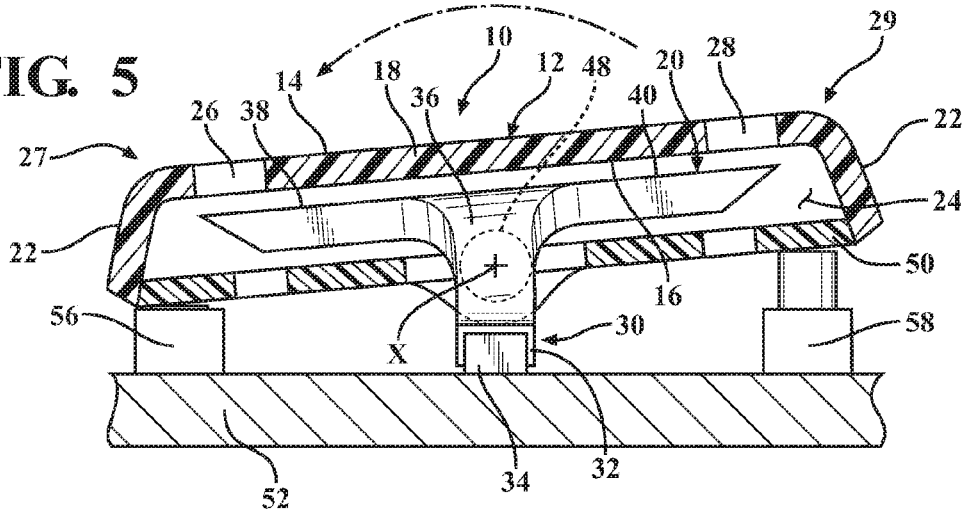
FIG. 5 is a side cross-sectional view of the button assembly of FIGS. 1-2 and 4 in a first actuated position, in accordance with the principles of the present disclosure.
Figure 6:
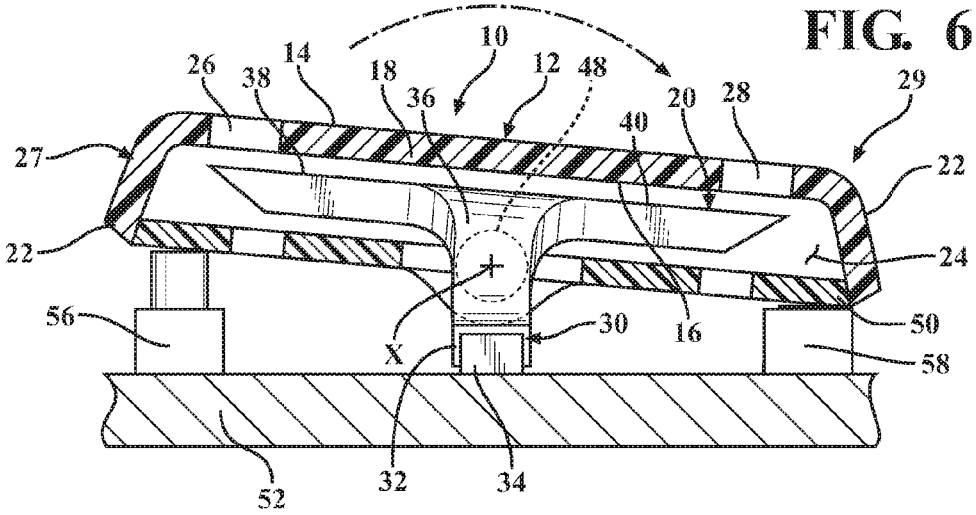
FIG. 6 is a side cross-sectional view of the button assembly of FIGS. 1-2 and 4-5 in a second actuated position, according to the principles of the present disclosure.

Referring to FIGS. 4-6, the rocker button 12 is pivotable about an axis X to rotate between a neutral or lifted position (FIG. 4), a first actuated position (FIG. 5), and a second actuated position (FIG. 6). The rotational axis X is located in a center of the rocker button 12. Thus, the first and second ends 127 of the button 12 both rotate and translate with respect to the bezel 42.

The rocker button 12 is configured to be pressed by a user at the first end 27 to push the button 12 into the first actuated position shown in FIG. 5. When in the first actuated position, the rocker button 12 engages the first tactile switch 56 to initiate a first command signal. The user may pivot the button 12 back into the lifted or neutral position, wherein the button 12 refrains from engaging either tactile switch 56, 58 (see FIG. 4), and/or the user may pivot the rocker button into the second actuated position (see FIG. 6), wherein the rocker button 12 engages the second tactile switch 58 to initiate a second command signal. If desired, the assembly 10 could include one or more springs, such as leaf springs, to return the rocker button 12 to the neutral position after it is depressed.

The body 36 of the flexible light conductor 20 is configured to bend when the rocker button 12 is moved between the positions shown in FIGS. 4-6, and the light-emitting portions 38, 40 of the flexible light conductor 20 are configured to move with the button 12. Since the inlet end 30 of the flexible light conductor 20 is fixed against movement with respect to the bezel 42, the PCB 52, and the light source 34, the inlet end 30 does not move with the rotation of the rocker button 12. The distance between the inlet end 30 including the light-receiving surface 32 and the light source 34 remains constant when the rocker button 12 pivots on the axis X. Thus, the inlet end 30 and the light-emitting portions 38, 40 of the flexible light conductor 20 move with respect to each other when the rocker button 12 is pivoted on the axis X.

Figure 7:
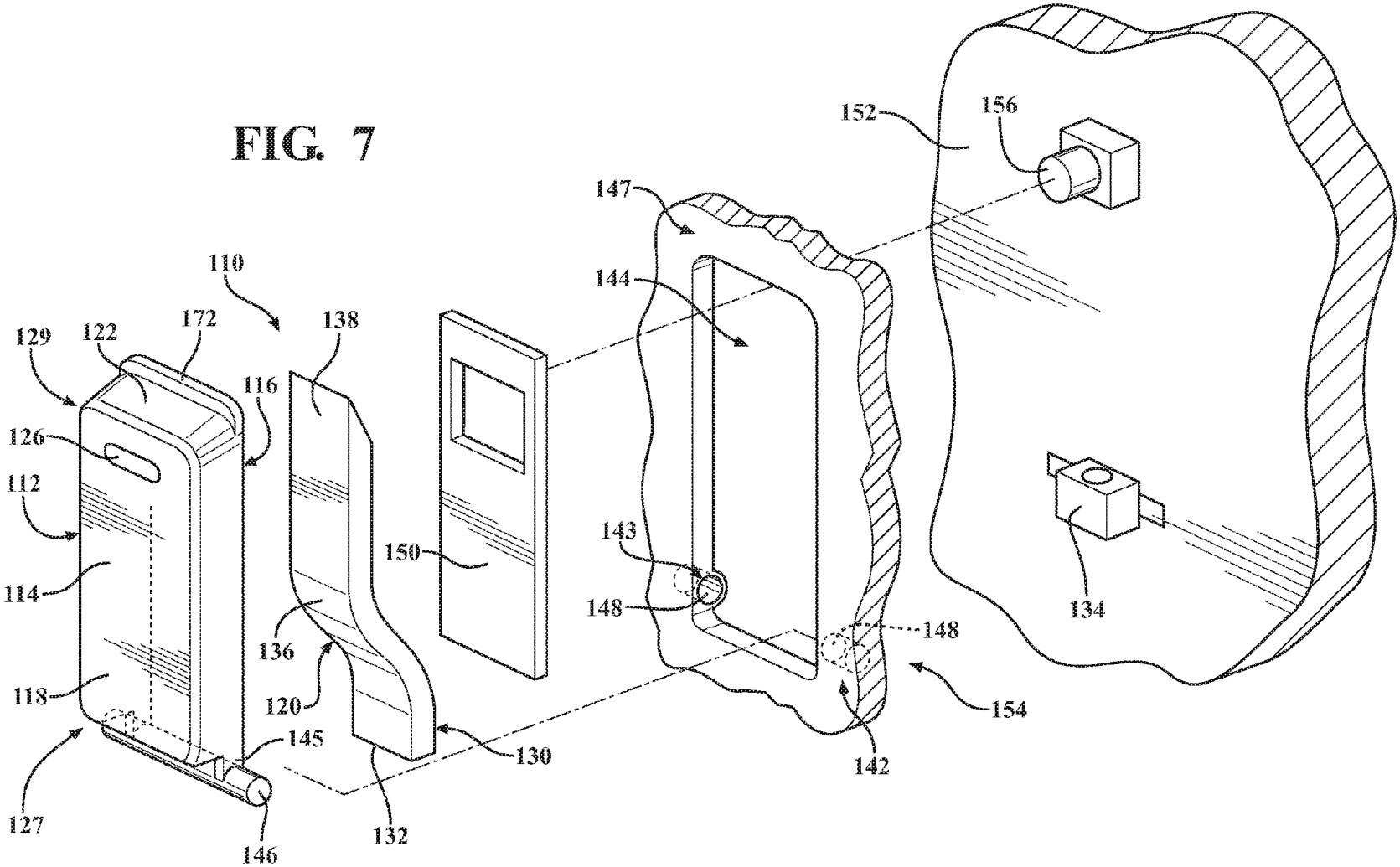
FIG. 7 is an exploded view of another button assembly, in accordance with the principles of the present disclosure.
Figure 8:
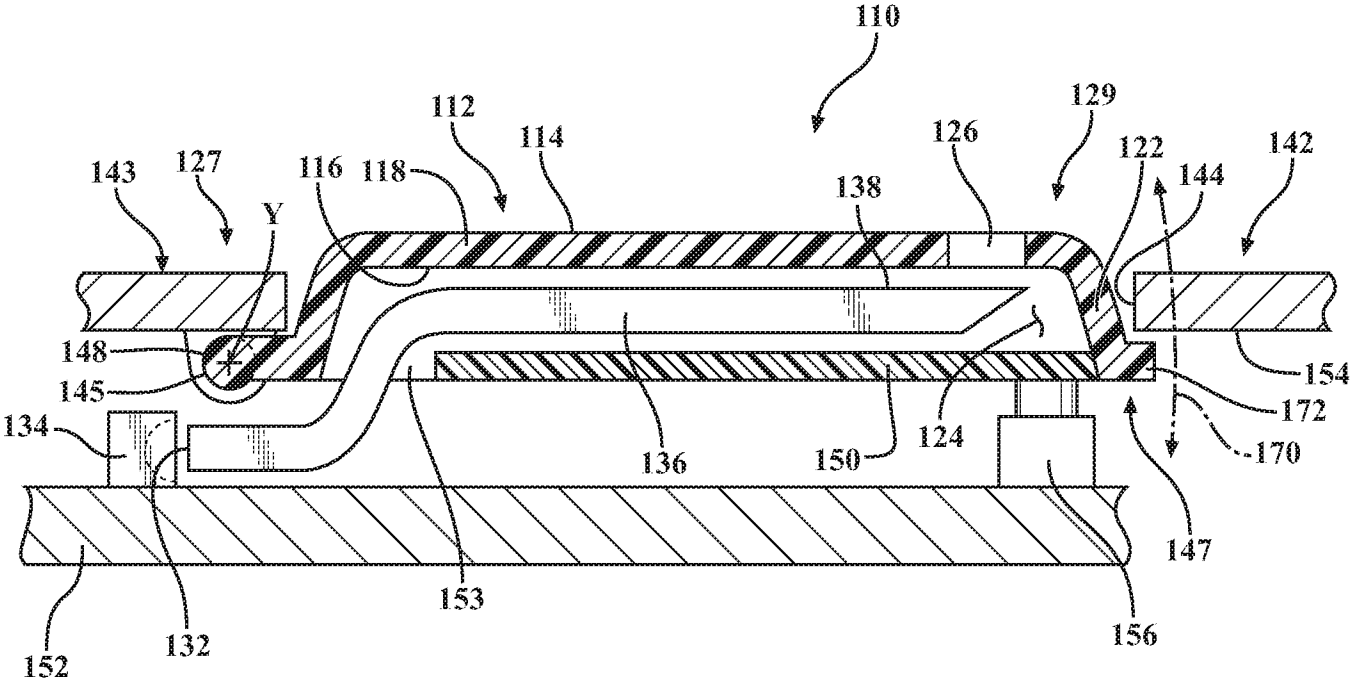
FIG. 8 is a side cross-sectional view of the button assembly of FIG. 7, according to the principles of the present disclosure.

Referring now to FIGS. 7-8, another button assembly is illustrated and generally designated at 110, which is a tilt button assembly. The tilt button assembly 110 has many of the same elements and configurations as the rocker button assembly 10 described above, and to the extent that no differences are described, the description above with respect to the rocker button assembly 10 also applies to the tilt button assembly 110.

The tilt button assembly 110 includes a movable tilt button 112, which has a top surface, or viewing surface 114, and a back side 116. The viewing surface 114 of the tilt button 112 may have a planar, flat shape, as shown, or in the alternative, the viewing surface 114 could be curved, by way of example. A main body 118 of the tilt button 112 may be formed of an opaque material, such as a plastic.

The tilt button 112 includes a first end 127 that is translationally fixed with respect to a bezel 142, and a second end 129 that is configured to rotate about a rotational axis Y disposed at the first end 127 of the tilt button 112. The second end 129 of the tilt button 112 is configured to rotate and translationally move with respect to the bezel 142. The tilt button 112 is rotatably mounted to a first end 143 of the bezel 142.

Like the rocker button assembly 10, the tilt button assembly 110 is configured to be illuminated and includes a flexible light conductor 120 disposed adjacent to the back side 116 of the tilt button 112. For example, the tilt button 112 may have sides 122 that defining a cavity 124 comprising the back side 116, and the flexible light conductor 120 may be partially disposed in the cavity 124. The flexible light conductor 120 may contact the back side 116 of the tilt button 112 or simply be disposed adjacent to the back side 116.

The tilt button 112 has portions defining one or more windows 126 in the viewing surface 114. In this example, the window 126 is disposed at the second end 129 of the tilt button 112. The window 126 may comprise transparent or translucent material, or no material, that allows light to be visible through the window 126. As explained more below, the window 126 may form a graphical, alphabetical, or numerical shape to display pictures, words, or numbers, if desired.

The flexible light conductor 120 has an inlet end 130 having a light-receiving surface 132 configured to receive light from a light source 134. The flexible light conductor 120 is configured to receive light into the light-receiving surface 132 of the inlet end 130 and to conduct the light through the body 136 of the flexible light conductor 120 to a light-emitting portion or surface 138. The light-emitting surface 138 is disposed adjacent to the window 126, and the light-emitting surface 138 is configured to emit light so that the light is visible through the window 126. The flexible light conductor 120 may be formed of silicon, for example, as described above with respect the flexible light conductor 20.

The bezel 142 defines an opening 144, and the tilt button 112 is partially located in the opening 144. The first end 127 of the tilt button 112 is rotatably mounted to the bezel 142 at the first end 143 of the bezel 142, for example, by a shaft 145 having peg ends 146 disposed on the first end 127 of the tilt button 112. The peg ends 146 are mated with sockets 148 formed in the bezel 142. The peg ends 146 can be snapped into the sockets 148. It should be understood that pegs could alternatively be located on the bezel 142 and the sockets on the tilt button 112, similar to the configuration of FIGS. 1-6.

A backing plate 150 fixes the light-emitting portion 138 of the flexible light conductor 120 to the tilt button 112. For example, the backing plate 150 may be press-fit or attached in any other suitable way to the tilt button 112. The backing plate 150 is attached over the back side 116 of the tilt button 112, with the light-emitting portion 138 of the flexible light conductor 120 being sandwiched between the backing plate 150 and the back side 116 of the tilt button 112. Therefore, the light-emitting portion 138 is movable with the tilt button 112, so that the light-emitting portion 138 and the tilt button 112 are rotatable with respect to the bezel 142.

While the light-emitting portion 138 of the flexible light conductor 120 is movable with respect to the bezel 142, the inlet end 130 of the flexible light conductor 120 is fixed with respect to the bezel 142. The inlet end 130 may be fixed to, or with respect to, a printed circuit board (PCB) 152, which is fixed with respect to the bezel 142. The PCB 152 may be disposed on a rear side 154 of the bezel 142. The light source 134, which may be an LED, may be disposed on the PCB 152 adjacent to the light-receiving surface 132. The LED 134 may be a side-emitting LED 134, such that rays from the LED 134 are emitted in a direction generally parallel to the PCB 152 and generally perpendicular to the light-receiving surface 132 of the flexible light conductor 120. Thus, the light-receiving surface 132 lays generally perpendicular to the PCB 152.

The body portion 136 of the flexible light guide 120 extends out of the cavity 124 through an opening 153 defined between the attached backing plate 153 and the tilt button 120. Thus, the light source 134 can be disposed outside of the cavity 124 but still illuminate the window 126 through the use of the flexible light guide 120.

A tactile switch 156 may also be disposed on the PCB 152 adjacent to a second end 147 of the bezel 142. The second end 129 of the tilt button 112 is configured to actuate the tactile switch 156. When the second end 129 of the tilt button 112 is pressed toward the tactile switch 156, the tactile switch 156 is depressed by the second end 129 of the tilt button 112, for example, via the backing plate 150. The tilt button 112 is pivotable about an axis Y to rotate between a neutral or lifted position (FIG. 8) and an actuated position (not shown, but represented by arrows 170).

The tilt button 112 is configured to be pressed by a user at the second end 129 to push the tilt button 112 into the actuated position. When in the actuated position, the tilt button 112 engages the tactile switch 156 to initiate a command signal. The user may pivot the tilt button 112 back into the lifted or neutral position, wherein the button 112 refrains from engaging the tactile switch 156 (see FIG. 4), and/or the assembly 110 could include one or more springs (not shown), such as leaf springs, to return the tilt button 112 to the neutral position after it is depressed. In some examples, the tactile switch 156 itself may have spring characteristics in the contact part 159 of the tactile switch 156.

The tilt button 112 may include a lip 172 that engages the bezel 142 in the neutral position to prevent the second end 129 of the tilt button 120 from coming completely out of the opening 144 of the bezel 142.

The body 136 of the flexible light conductor 120 is configured to bend when the tilt button 112 is moved between the neutral position and the actuated position, and the light-emitting portion 138 of the flexible light conductor 120 is configured to move with the tilt button 112. Since the inlet end 130 of the flexible light conductor 120 is fixed with respect to the bezel 142, the PCB 152, and the light source 134, the inlet end 130 does not move with the rotation of the tilt button 112. The distance between the inlet end 130 including the light-receiving surface 132 and the light source 134 remains constant when the tilt button 112 pivots on the axis Y. Thus, the inlet end 130 and the light-emitting portion 138 of the flexible light conductor 120 move with respect to each other when the tilt button 112 is pivoted on the axis Y.

The viewing surfaces of the buttons 12, 112 may display an image or images, such as a graphic, words, or numbers, on either or both of the main body 18, 118 and the windows 26, 28, 126. The flexible light guides 20, 120 may be used to illuminate such images if the images are disposed on or as part of the windows 26, 28, 126.

The circuit boards 52, 152 are configured to facilitate the communication of signals from the button assemblies 10, 110 to another controller to which the button assemblies 10, 110 are being used in connection with. The button assemblies 10, 110 can be used in connection with a variety of different applications including, but are not limited to, vehicle infotainment systems, sound radio systems, environmental HVAC systems, communications, driver interface modules, global positioning systems, vehicle lighting, vehicle audio, or virtually any other type of system in a vehicle. The button assemblies 10, 110 can be programmed to control any number of functions, including but not limited to radio controls, such as mode, volume, tuner, bass, treble, speaker controls, HVAC controls including temperature, fan speed, vent controls, telephone or media controls including DVD or video controls, window actuators, cruise controls, lights controls, etc. It is also within the scope of this disclosure for the circuit boards 52, 152 to contain a controller or some other logic that allows for the processing and execution of the function signals generated when a person engages one of the tactile switches 56, 58, 156 through one of the buttons 12, 112.

The description is merely exemplary in nature and, thus, variations that do not depart from the gist are intended to be within the scope of the disclosure. Such variations are not to be regarded as a departure from the spirit and scope of the disclosure or the invention.

What is claimed is:

1. A tilt button assembly comprising:

a bezel defining an opening, the bezel having a first end and a second end;

a tilt button rotatably mounted to the first end of the bezel and at least partially located within the opening, the tilt button being pivotable about an axis between a neutral position and an actuated position, the tilt button having a viewing surface and a back side, the viewing surface having portions defining a window;

a flexible light conductor disposed adjacent to the back side of the tilt button, the flexible light conductor having a substantially planar light-receiving inlet end configured to receive light, the flexible light conductor having a light-emitting portion disposed adjacent to the window, the flexible light conductor being configured to conduct light from the substantially planar light-receiving inlet end to the light-emitting portion, the light-emitting portion being configured to emit light so that the light is visible through the window; and a backing plate fixing the light-emitting portion to the tilt button, the light-emitting portion being movable with the tilt button, the flexible light conductor extending through an opening defined by at least one of the tilt button and the backing plate, wherein the substantially planar light-receiving inlet surface of the flexible light conductor is fixed against movement with respect to the bezel.

2. The tilt button assembly of claim 1, further comprising a light source disposed adjacent to the substantially planar light-receiving inlet end of the flexible light conductor, the light source being fixed against movement with respect to the bezel and the substantially planar light-receiving inlet end, the light-emitting portion and the tilt button being movable with respect to the light source, the tilt button assembly further comprising a tactile switch and a printed circuit board, the tactile switch being disposed on the printed circuit board adjacent to the second end of the bezel, wherein pivoting the tilt button to the actuated position causes the tilt button to actuate the tactile switch to initiate a command signal, the tilt button comprising a lip configured to engage the bezel in the neutral position, the backing plate and the tilt button cooperating to define the opening through which the flexible light conductor extends.

* * * * *